US006217013B1

(12) United States Patent
Foreman

(10) Patent No.: US 6,217,013 B1
(45) Date of Patent: Apr. 17, 2001

(54) WORKPIECE HOLDER ASSEMBLY FOR VACUUM-HOLDING A WORKPIECE FOR MACHINING

(75) Inventor: Douglas Foreman, Kent, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/342,770

(22) Filed: Jun. 29, 1999

(51) Int. Cl.[7] ..... B25B 11/00
(52) U.S. Cl. ..... 269/21
(58) Field of Search ..... 269/21, 263, 255, 269/264

(56) References Cited

U.S. PATENT DOCUMENTS

| | | | | |
|---|---|---|---|---|
| 2,573,087 | | 10/1951 | Youngblood et al. . | |
| 3,967,816 | | 7/1976 | Ramsperger et al. . | |
| 4,468,854 | * | 7/1998 | Chou et al. | 269/21 |
| 4,729,804 | | 3/1988 | Dillner . | |
| 5,253,454 | | 10/1993 | Carlson et al. . | |
| 5,316,255 | * | 5/1994 | Marcusen | 269/21 |
| 5,667,128 | * | 7/1998 | Rohde et al. | 269/21 |
| 5,730,431 | | 3/1998 | Cattini . | |
| 5,775,395 | * | 7/1998 | Wilkins | 269/21 |
| 5,853,169 | * | 12/1998 | Hern et al. | 269/21 |

* cited by examiner

*Primary Examiner*—James G. Smith
*Assistant Examiner*—Lee Wilson
(74) *Attorney, Agent, or Firm*—Alston & Bird LLP

(57) ABSTRACT

A workpiece holder assembly for vacuum-holding an aircraft wing skin or other workpiece for machining includes a base plate formed preferably of metal and adapted to be installed in a well area of a mill bed having vacuum passages therein, and an insert tool formed preferably of polymer material and adapted to be removably installed in a recess formed in the base plate. The base plate and insert tool have vacuum holes extending therethrough for communication with the vacuum passages in the mill bed. The surface of the insert tool facing away from the base plate includes one or more seal strips retained in grooves for sealing against a surface of a wing skin or other workpiece, and also includes one or more depressed regions for accommodating one or more protruding features that project from the workpiece surface, such as padups, steps, or taper planes on the inboard end of a wing skin panel. A plurality of insert tools having different configurations adapted to accommodate different workpiece configurations are interchangeably installable in the recess of a single common base plate. The tooling is converted to a different configuration for machining a different workpiece configuration by removing the existing insert tool from the base plate and installing a new insert tool. The invention facilitates manual conversion of the tooling by virtue of the removable insert tools, which can be made light enough in weight to be readily installed and removed by a worker without the use of cranes or other heavy equipment.

15 Claims, 3 Drawing Sheets

WORKPIECE HOLDER ASSEMBLY FOR VACUUM-HOLDING A WORKPIECE FOR MACHINING

FIELD OF THE INVENTION

The invention relates to milling machines for machining metallic workpieces. The invention relates more particularly to milling machines for machining wing skins of an aircraft, in which both surfaces of the wing skin must be machined in sequence.

BACKGROUND OF THE INVENTION

Wing skins for aircraft are typically machined from metal plate stock that is essentially flat on both sides. In accordance with one known technique for machining a wing skin, a plate is held down on a mill bed by the use of vacuum exerted on an under surface of the plate. The upper surface of the plate is then machined to the desired contour. The first side machined is generally the aerodynamic surface, also known as the "outside mold line" or OML. The majority of the OML surface is smooth, but at the inboard end of the wing skin there typically are protruding features such as padups, steps, or taper planes serving to enable the wing skin to be attached to the fuselage or other structure.

After the OML surface is machined, the wing skin is turned over on the mill bed so that the other surface of the plate can be machined to form the "inside mold line" or IML. The protruding features at the inboard end of the wing skin are accommodated in pockets or depressed regions of a plate-shaped metallic adapter tool that fits into a well area defined in the mill bed. This adapter tool enables the wing skin to fit snugly against the seal that engages the wing skin for vacuuming the wing skin down onto the mill bed so that the IML can be machined.

Each aircraft model has unique wing skin configurations with unique protruding features, and hence, whenever it is desired to machine a new wing skin configuration, the existing adapter tool must be removed from the well area of the mill bed and a new adapter tool having the appropriate configuration for the new wing skin must be installed in the well area. Each such adapter tool typically can be 60 inches wide, 80 inches long, and 1.125 inches thick, and can weigh 600 pounds. Accordingly, it will be appreciated that the adapter tools cannot be handled manually, but must be moved through the use of heavy equipment such as cranes. It can take two hours for removing an adapter tool and installing a new adapter tool in the mill bed. Every time a new wing skin configuration is to be machined, the adapter tool must be removed and replaced with a different one. Thus, the significant time required for changing the heavy adapter tools introduces considerable inefficiencies in the manufacturing process. Furthermore, a significant capital expenditure is required where a substantial number of different wing skin configurations must be machined, because each wing skin configuration requires its own adapter tool, and each tool can be quite expensive.

SUMMARY OF THE INVENTION

The present invention enables the time required for changing the tooling to be substantially reduced, for example, from about two hours to about 15 minutes. The invention also enables a substantial reduction in the capital expenditure required for tooling where a substantial number of different wing skin configurations are to be machined. Additionally, the invention facilitates improved safety conditions for workers involved in changing the tooling.

The invention can achieve the above and other advantages by eliminating the requirement of changing a large and heavy metallic tool every time a new wing skin configuration is to be machined. To this end, the invention provides a workpiece holder assembly comprising a base plate adapted to be received in the well area of a mill bed, and an insert tool that is received in a recess defined in the upper surface of the base plate. The insert tool's upper surface includes one or more depressed regions configured to accommodate one or more protruding features on a previously machined contour of a wing skin or other workpiece. The base plate and insert tool have vacuum passages adapted to communicate with the vacuum system of the mill bed such that a vacuum can be exerted on the workpiece. A seal is provided on the upper surface of the insert tool for sealingly engaging the workpiece so that the workpiece can be vacuumed down to permit the other surface of the workpiece to be machined. When a new workpiece configuration is to be machined, the insert tool is removed and replaced with a new insert tool configured to match the contour of the new workpiece configuration. Each insert tool advantageously is configured so that it can be received in the recess in the base plate, such that any of a plurality of insert tools can be installed in the recess. Accordingly, the base plate need not be changed when changing to a new workpiece configuration.

The base plate preferably is metallic. The insert tool, however, advantageously is made of a lightweight material such as a polymer material preferably having good resistance to oils and lubricants commonly used in milling operations. Thus, the insert tool can be made light enough in weight to enable workers to manually remove the insert tool and replace it with a different insert tool. The time required for a tooling change consequently can be substantially reduced. Moreover, tooling changes can be made safer by the elimination of the need to move heavy metallic plates with cranes or the like.

In accordance with a preferred embodiment of the invention, the insert tool includes vacuum holes formed through the thickness of the tool for providing a vacuum at the upper surface of the tool. The vacuum holes act in cooperation with one or more elongate seal strips extending along the upper surface of the insert tool so as to sealingly engage a workpiece and suction it against the tool and the mill bed. Advantageously, the insert tool also includes a series of vacuum slots formed in its upper surface in communication with the vacuum holes so that vacuum is more uniformly distributed over the surface of the insert tool.

Where the mill bed includes two separate vacuum systems independently feeding two dedicated sets of vacuum passages through the well area in the mill bed, the base plate and the insert tool each advantageously includes two separate sets of vacuum holes respectively communicating with the two sets of vacuum passages in the mill bed. The insert tool further includes two seals disposed with one seal spaced along the upper surface of the insert tool interior of the other seal such that an outer peripheral waste portion of a workpiece can be cut from the remainder of the workpiece along a path located between the outer and inner seals. One set of vacuum holes in the insert tool is located interior of the inner seal, and the other set of vacuum holes is located between the inner seal and the outer seal, so that vacuum can be independently exerted on the waste portion and the remainder of the workpiece.

The invention thus facilitates the milling of thin plate-shaped workpieces such as wing skins on both surfaces, and enables a plurality of different machined configurations to be produced with greatly reduced time required for tooling changes relative to the conventional method employing large metallic adapter plates. The insert tools can be manually interchanged, thus improving the safety of the tool change procedure. A single metallic base plate can receive a plurality of different insert tools, which are substantially less costly to manufacture than conventional metallic adapter tools, and thus the invention facilitates a substantial reduction in the capital expenditures required for tooling.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
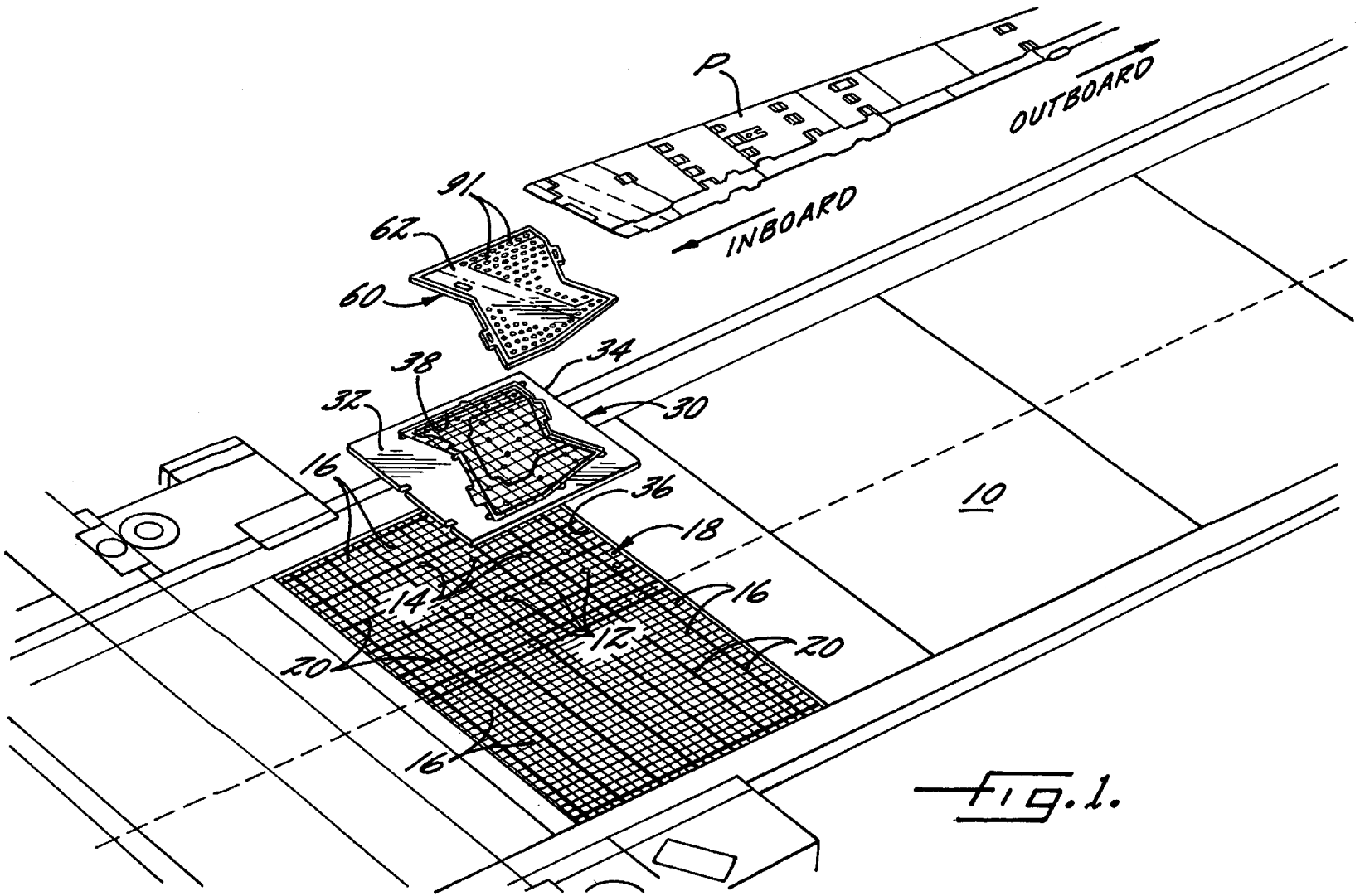
FIG. 1 is an exploded perspective view of a workpiece holder assembly in accordance with a preterred embodiment of the invention.

FIG. 1 depicts an exploded perspective view of a tooling arrangement for machining a wing skin panel in accordance with a preferred embodiment of the invention. A generally flat mill bed 10 is provided for supporting a wing skin panel P and for suctioning the panel P against the mill bed 10 to hold it in position so that the panel P can be machined on its surface that faces away from the mill bed 10, and so that the panel P can have other machining operations performed on it, such as cutting the panel to a net planform shape, if desired. As an example, a typical wing skin panel P may have a length of about 400–1200 inches and a maximum width at the inboard end of about 40–72 inches. The mill bed 10 comprises a plate-like structure of substantial thickness and adequate width and length to accommodate at least one, and typically more than one, wing skin panel P to be machined at a time. For the purposes of the present description, however, it is assumed that only one wing skin panel P is to be machined on the mill bed 10 at any given time. The upper surface of the mill bed 10 is generally planar, except for certain features thereof that are explained below.

The wing skin panel P is held down to the mill bed 10 by a system of vacuum passages and seals that engage the lower surface of the panel P such that a vacuum can be exerted against the lower surface of the panel. More specifically, the mill bed 10 includes a plurality of vacuum ports 12 and vacuum ports 14 and a distribution grid of vacuum slots 16 formed in and extending along the upper surface of the mill bed 10. The vacuum slots 16 communicate with the vacuum ports 12 and 14 for distributing vacuum from the ports over a desired area of the mill bed generally corresponding to the area covered by a panel P.

The mill bed 10 includes a well area 18 that is depressed below the upper surface of the remainder of the mill bed. Vacuum ports 12 and 14 and vacuum slots 16 are formed in the mill bed so as to open into the well area 18. Rubber seals 20 are disposed along the upper surface of the mill bed in the well area 18. Although not shown, it will be understood that there are also vacuum ports, vacuum slots, and rubber seals along the upper surface of the mill bed outside the well area 18 for exerting vacuum against the portion of the wing skin panel P lying outside the well area.

Figure 2:
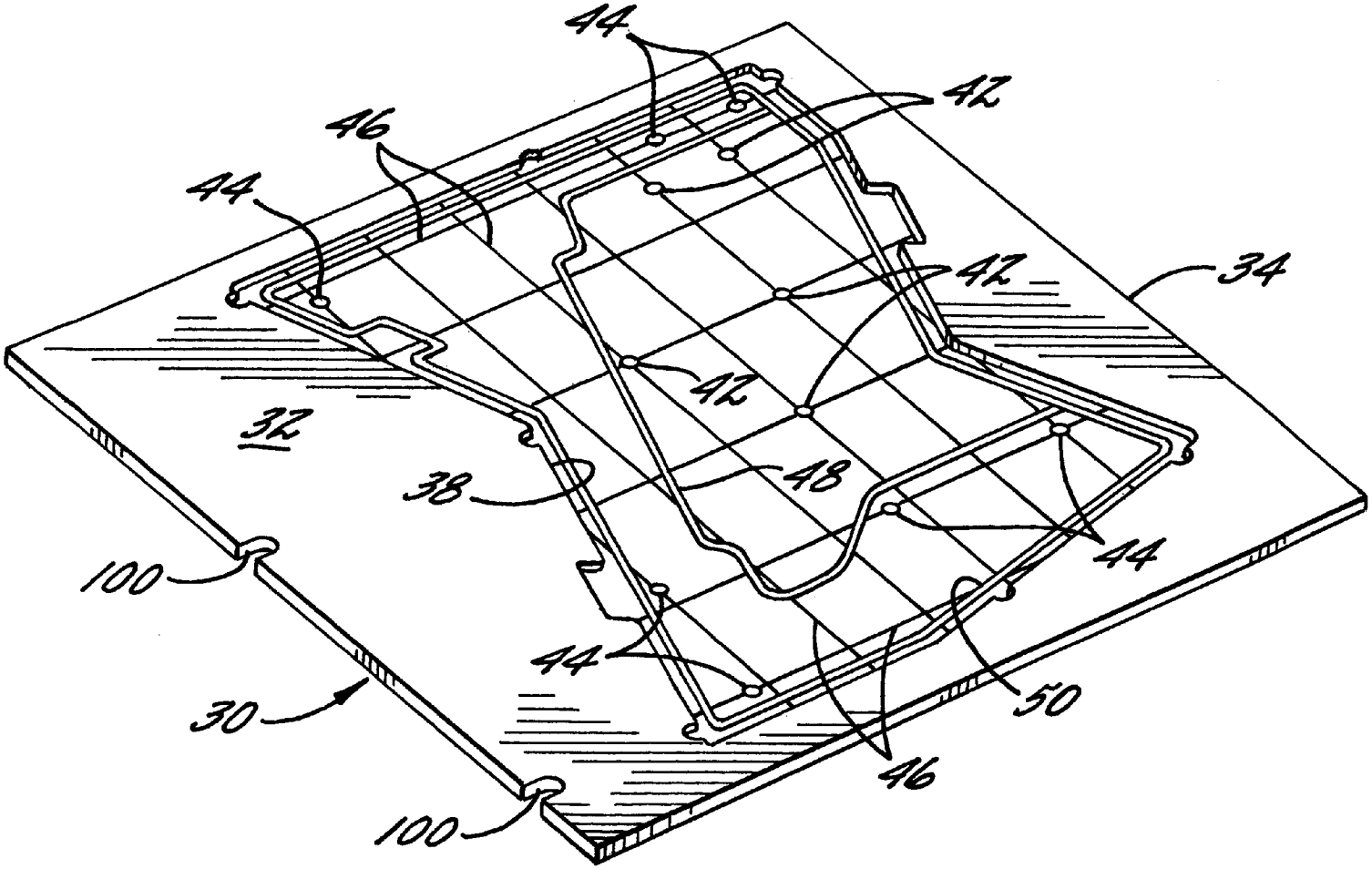
FIG. 2 is a perspective view of a base plate in accordance with a preferred embodiment of the invention.

A base plate 30, preferably formed of aluminum or other material of adequate strength, is configured with appropriate width and length dimensions so as to be capable of being received into the well area 18 and to rest upon the upper surface thereof. A representative base plate 30 is shown in greater detail in FIG. 2. The thickness of the base plate 30 preferably bears an appropriate relationship with the depth of the well area 18 such that when the base plate 30 is installed in the well area, the upper surface 32 of the base plate 30 is about flush with the upper surface of the mill bed 10 outside the well area. The base plate 30 is installed in the well area 18 such that the edge 34 of the base plate 30 that faces toward the outboard direction of the wing skin panel P is adjacent a corresponding edge 36 of the well area 18 so that there is no appreciable gap between the edges 34 and 36 and thus the base plate 30 and mill bed 10 collectively form a substantially continuous surface for supporting the wing skin panel P. The base plate 30 engages the rubber seals 20 in the well area so that vacuum can be exerted on the base plate 30 via the vacuum ports 12, 14 and vacuum slots 16. As an illustrative example of suitable dimensions of a base plate 30 for use in machining aircraft wing skin panels, the base plate 30 may have a width of about 60–80 inches, a length of about 60–120 inches, and a thickness of about 1–1.5 inches.

The base plate 30 includes a recess 38 in its upper surface 32 for receiving an insert tool 60 further described below. Within the recess 38, the base plate 30 includes one set of vacuum holes 42 and another set of vacuum holes 44, and a distribution grid of vacuum slots 46 that communicate with the vacuum holes 42, 44 for distributing vacuum over substantially the entire area of the recess 38. The vacuum holes 42 are within an area bounded by an internal seal 48 formed by an elongate strip of resiliently compressible material such as rubber retained in a groove formed in the surface of the base plate. The base plate 30 further includes an external seal 50 of similar construction to the internal seal 48. The external seal 50 extends generally about the periphery of the recess 38 in the base plate. The vacuum holes 44 are located between the internal seal 48 and the external seal 50. Thus, the vacuum holes 42 form an internal vacuum system and the vacuum holes 44 form an external vacuum system. The rationale for providing separate internal and external vacuum systems is explained below.

The vacuum holes 42 and 44 extend through the thickness of the base plate 30 and thus are open at the lower surface thereof. When the base plate 30 is installed in the well area 18 of the mill bed 10, the vacuum holes 42, 44 are in communication with corresponding vacuum ports 12, 14 in the well area. More specifically, the rubber seals 20 are located with respect to the vacuum ports 12 and 14 so that vacuum can be exerted through the vacuum ports 12 onto the base plate 30 independently of vacuum exerted through the vacuum ports 14 onto the base plate. Two separate vacuum pump systems (not shown) are provided for this purpose. The vacuum holes 42 and the internal seal 48 in the base plate 30 are suitably located such that the vacuum ports 12 in the well area 18 communicate only with the vacuum holes 42; similarly, the vacuum holes 44 and the external seal 50 in the base plate are located such that the vacuum ports 14 in the well area communicate only with the vacuum holes 44. As further described below, this enables a workpiece such as the panel P to be cut to a net shape along a cut line so as to remove a peripheral waste portion of the panel, with vacuum being independently exerted on the peripheral waste portion via the external vacuum system and external vacuum holes 44, and on the net shape part via the internal vacuum system and internal vacuum holes 42. It should be noted that the number and arrangement of the vacuum holes 42, 44 and vacuum slots 46 and the internal and external seals 48, 50 can be selected to suit any particular application, the illustrated arrangement being for the purpose of explanation only.

Figure 3:
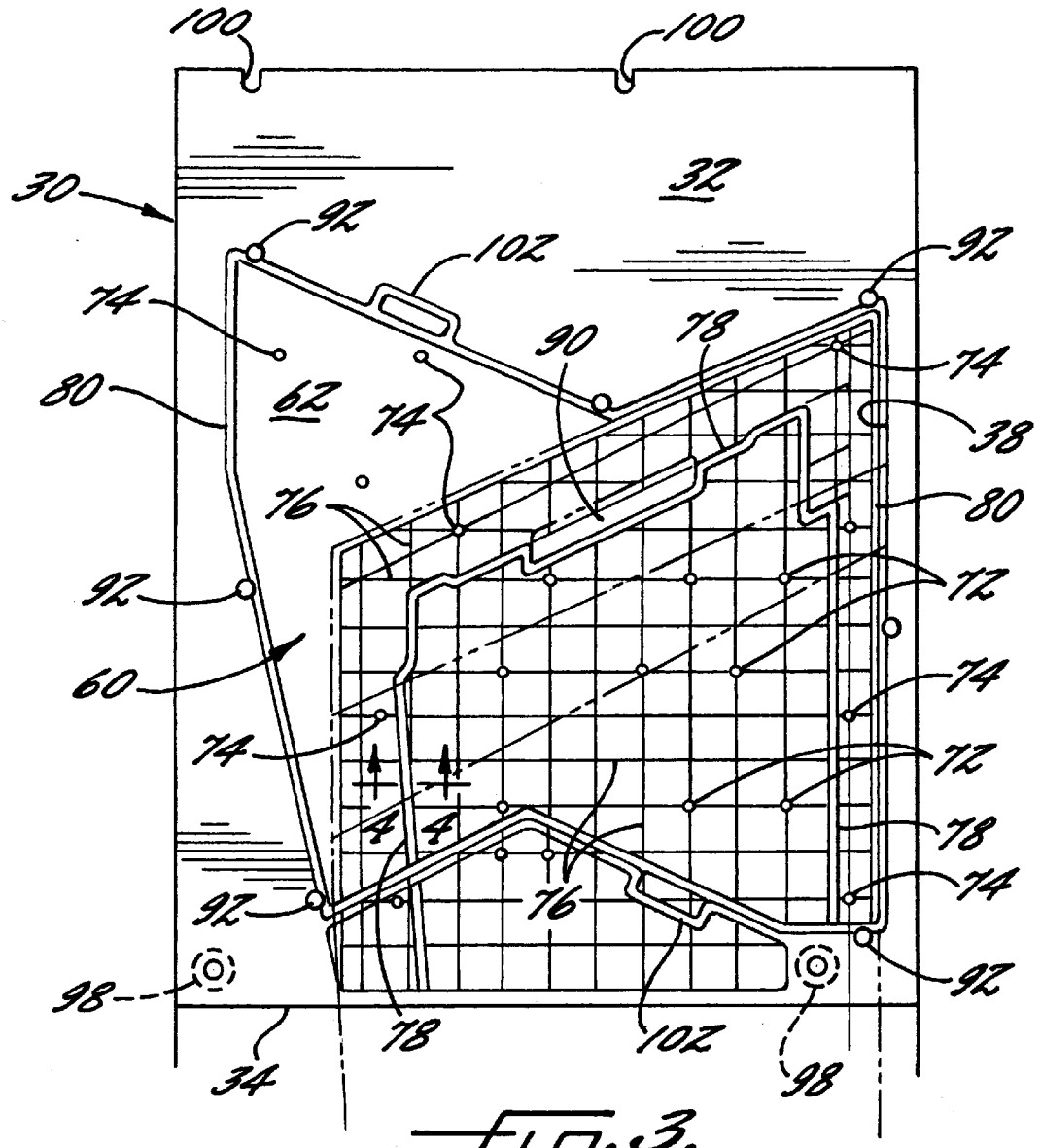
FIG. 3 is a top elevation of a base plate with an insert tool in accordance with a preferred embodiment of the invention installed therein.

As shown in FIG. 1, the tooling assembly of the invention further includes an insert tool 60 that nests into the recess 38 in the base plate 30. FIG. 3 shows the insert tool 60 nested in the base plate 30 in top elevation view. The insert tool 60 comprises a generally planar plate-like structure. The thickness of the insert tool 60 bears an appropriate relationship to the depth of the recess 38 in the base plate such that the upper surface 62 of the insert tool 60 is generally flush with the upper surface 32 of the base plate 30 when the insert tool is installed in the recess 38. The lower surface of the insert tool 60 is configured to sealingly engage the seals 48 and 50 in the base plate 30 such that vacuum can be exerted on the insert tool 60 via the vacuum holes 42, 44. As an illustrative example of suitable dimensions of an insert tool 60 for use in machining aircraft wing skin panels, the insert tool 60 may have a width of about 48–60 inches, a length of about 24–48 inches, and a thickness of about 0.6–1.0 inch. The insert tool 60 preferably is formed of a lightweight material such as a polymer material. The weight of an insert tool having the above dimensions and formed of ultra high molecular weight polyethylene may be about 20 to 50 pounds.

The insert tool 60 further includes a plurality of vacuum holes 72 and a plurality of vacuum holes 74 formed through its thickness, as best shown in FIG. 3. The vacuum holes 72 are located within an area bounded by an internal seal 78 that extends along the upper surface of the insert tool and is formed by an elongate strip of rubber or other suitable material retained in a groove in the insert tool. The vacuum holes 74 are located between the internal seal 78 and an external seal 80 that extends generally along the periphery of the insert tool 60 and is constructed in similar fashion to the internal seal 78. The upper surface of the insert tool 60 also includes a distribution grid of vacuum slots 76 that communicate with the vacuum holes 72, 74 for distributing vacuum over the surface of the insert tool. The vacuum holes 72 and the seals 78, 80 are located with respect to the vacuum holes 42 and the seals 48, 50 in the base plate 30 so that vacuum within the vacuum holes 42 is communicated only to the vacuum holes 72 in the insert tool. Similarly, the vacuum holes 74 in the insert tool 60 are located with respect to the vacuum holes 44 in the base plate 30 so that vacuum within the vacuum holes 44 is communicated only to the vacuum holes 74 in the insert tool. The vacuum holes 72 thus comprise an internal vacuum system and the vacuum holes 74 comprise an external vacuum system. When the wing skin panel P is suctioned against the insert tool by the vacuum holes 72, 74 and seals 78, 80, a peripheral portion of the panel P outward of the internal seal 78 is suctioned by vacuum delivered through the external vacuum holes 74, and the interior portion of the panel P within the internal seal 78 is suctioned by vacuum delivered through the internal vacuum holes 72. Accordingly, if desired, the panel P can be cut to a net shape by cutting along a cut line that extends between the external seal 80 and the internal seal 78 while preserving vacuum on both the interior portion and the peripheral waste portion of the panel.

The insert tool 60 further includes one or more depressed regions 90 formed in its upper surface. The depressed regions 90 are configured and located so as to receive one or more protruding features on the surface of the wing skin panel P that rests atop the insert tool 60. Such protruding features may be formed, for example, when one surface of a wing skin panel is machined on the insert tool 60 and mill bed 10 and the panel is then turned over and placed on the insert tool and mill bed to machine the other surface of the panel. In the manufacture of wing skins for aircraft, the inboard end of a wing skin panel (i.e., the end supported on the insert tool 60) frequently has one or more protruding features such as padups, taper planes, steps, or the like for mounting the panel to the fuselage or other structure. These protruding features project above the remainder of the aerodynamic surface or "outside mold line" (OML) of the wing skin, which is usually the first surface of the panel to be machined. Thus, when the panel is turned over to machine the other surface or "inside mold line" (IML), the protruding features would interfere with proper sealing between the panel and the seals 78, 80 of the insert tool 60 were it not for the depressed regions 90. The depressed regions 90 receive the protruding features so that the panel can properly engage the seals on the insert tool.

In accordance with the present invention, the insert tool 60 can readily be installed manually in the recess 38 of the base plate 30 and removed therefrom. The weight of the insert tool 60 can be kept to a minimum by constructing the insert tool of a suitable polymer material having good resistance to oils and lubricants commonly used in the machining of metals. For example, the insert tool can be made of ultrahigh molecular weight polyethylene. The weight of the insert tool can be further reduced by removing "pockets" 91 (FIG. 1) of material from the lower surface thereof over those portions of the surface that are not in engagement with the seals 48, 50 of the base plate 30. The base plate 30 preferably includes releasable cams or clamps 92 (FIG. 3) for engaging the edges of the insert tool 60 to retain the insert tool within the base plate when the vacuum system is inoperative.

Figure 4:
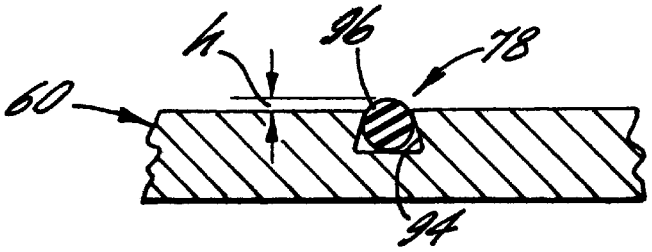
FIG. 4 is a cross-sectional view taken on line 4—4 of FIG. 4.

The construction of the seals 78, 80 of the insert tool 60 preferably employs dovetail-shaped grooves 94 as shown in FIG. 4. The grooves 94 have a minimum width adjacent the upper surface of the insert tool. A round strip 96 of rubber or other seal material is interference fit within the groove 94 by virtue of having a diameter slightly greater than the minimum width of the groove 94. The depth of the groove 94 is such that the seal strip 96 projects above the surface of the insert tool by an amount h. As an example of suitable dimensions for an insert tool in accordance with the present invention, the thickness of the insert tool 60 can be about 0.75 inch. The seal groove 94 can be about 0.325 inch wide at the widest point and about 0.26 inch wide at the narrowest point adjacent the upper surface of the insert tool. The seal strip 96 can have a diameter of about 0.275 inch. The seal strip 96 advantageously projects above the upper surface of the insert tool 60 by a height h of about 0.045 inch. It should also be noted that the seals 48, 50 in the base plate 30 are preferably constructed with dovetail-shaped grooves and round seal strips, similar to the seals 78, 80 in the insert tool 60.

A procedure for machining a wing skin panel P is now described. Prior to positioning the wing skin panel P on the mill bed 10, a base plate 30 is lowered by a crane or other suitable device into the well area 18 of the mill bed 10. The base plate 30 preferably includes lift ring plates 98 (FIG. 3) that can be engaged by a fixture attached to a crane for lifting the base plate 30,transporting it to a position over the well area 18, and lowering it into the well area 18. The base plate 30 preferably also has locator notches 100 (FIG. 3) that are engaged by locator pins (not shown) provided in the mill bed 10 so that the base plate 30 is properly located in the well area 18. Next, an insert tool 60 is manually placed into the recess 38 in the base plate 30 and the clamps 92 are operated to secure the insert tool within the base plate. The insert tool 60 advantageously includes one or more handles 102 (FIG. 3) integrally formed thereon to facilitate manual manipulation and transportation of the insert tool. A plate stock for manufacturing a wing skin panel is then lowered by a vacuum lift and cranes onto the mill bed 10 such that the inboard end of the plate stock is seated on the insert tool 60 in an appropriate location with respect to the seals 78, 80. It should be noted that there are also seals (not shown) in the mill bed 10 outside the well area 18, and the plate stock also engages these seals so that it can be suctioned onto the mill bed along substantially the entire length of the plate stock. Once the plate stock is properly positioned on the mill bed 10 and insert tool 60, one of the two independent mill bed vacuum systems is operated to cause vacuum to be exerted through the vacuum ports 12 and vacuum grooves 16 in the well area 18, through the corresponding vacuum holes 42 and vacuum grooves 46 in the base plate 30, and through the corresponding vacuum holes 72 and vacuum slots 76 in the insert tool 60 onto an interior portion of the plate stock. The other mill vacuum system is also operated to cause vacuum to be exerted through the vacuum ports 14 and vacuum grooves 16 in the well area 18, through the corresponding vacuum holes 44 and vacuum grooves 46 in the base plate 30, and through the corresponding vacuum holes 74 and vacuum slots 76 in the insert tool 60 onto a peripheral portion of the plate stock. The surface of the plate stock facing away from the mill bed 10 is then machined by suitable equipment (not shown) to produce the desired surface contour for the OML surface of the wing skin panel P. One or more protruding features are typically machined at the inboard end of the panel P so that they project above the remainder of the generally smooth OML surface. As previously noted, the plate stock can also be cut to a desired net shape, if necessary.

After the OML surface is machined, the mill vacuum systems are turned off and vacuum lifts and cranes are used to lift the panel P off the mill bed 10, turn the panel over, and replace the panel atop the mill bed so that the opposite surface of the panel can be machined. Typically, before the panel is replaced on the mill bed, the mill bed 10, base plate 30, and insert tool 60 are cleaned to remove cut chips that might interfere with proper seating of the panel on the seals. Compressed air is typically used for blowing the chips off the tooling. Incidentally, one advantage of using dovetail-shaped grooves 94 and round seal strips 96 is that the seal strips 96 are less likely to be blown out of the grooves 94 during this cleaning process, in comparison to constant-width grooves and rectangular seal strips, which tend to be more easily dislodged from the grooves. Furthermore, the round seal strips 96 also tend to remain in the grooves 94 when the insert tool 60 is placed vertically in a storage rack.

The inboard end of the panel P is appropriately positioned so that the protruding features on the OML surface are received into the corresponding depressed regions 90 in the insert tool 60. The mill vacuum systems are turned back on, and the inside mold line of the panel P is machined. The mill vacuum systems are then deactivated, and the finished panel P is removed.

In accordance with the present invention, panels of various configurations can be machined without having to replace the relatively heavy and unwieldy base plate 30 before each new configuration of panel is machined. To this end, the recess 38 in the base plate 30 is appropriately configured to accommodate any of a plurality of different insert tools 60. In terms of a design process, the base plate 30 is first sized to accommodate a recess 38 large enough to receive the largest of the various insert tools 60. The various insert tools 60 are then appropriately configured to fit within this recess 38. Each of the insert tools 60 can be formed with different configurations of vacuum holes 72, 74 and seals 78, 80 and different configurations of depressed regions 90 so as to accommodate a different wing skin panel configuration. Accordingly, to convert the tooling assembly for machining a new wing skin panel configuration, the existing insert tool 60 is simply removed and replaced with the appropriate insert tool 60 corresponding to the new wing skin panel.

Many modifications and other embodiments of the invention will come to mind to one skilled in the art to which this invention pertains having the benefit of the teachings presented in the foregoing descriptions and the associated drawings. For example, although the insert tool 60 and base plate 30 have been described as each including two seals for providing two independently operable vacuum systems, the invention also encompasses insert tools and base plates each having at least one seal. Only one seal may be needed where, for example, there is no need to provided two independent vacuum systems. Additionally, although the invention has been described with reference to machining thin plate-shaped workpieces, it will be recognized that the principles of the invention are applicable to other configurations of workpieces. Other modifications to the described embodiment of the invention can also be made within the scope of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A workpiece holder assembly for vacuum-holding a workpiece for machining, the workpiece holder assembly comprising:

a base plate having upper and lower surfaces, the base plate being adapted to be received within a recessed well of a generally flat mill bed defining vacuum passages therein, the base plate defining vacuum passages and being adapted to be installed in the well such that communication exists between the vacuum passages of the mill bed and the vacuum passages of the base plate, the upper surface of the base plate defining a recess therein, and the vacuum passages opening into the recess;

an insert tool configured to be removably received in the recess of the base plate such that an upper surface of the insert tool and the mill bed collectively define a generally continuous surface for supporting a workpiece to be machined and such that the insert tool is maintained in a fixed position within the recess during machining of the workpiece, the insert tool defining vacuum passages opening at the upper surface thereof, the vacuum passages being configured such that communication exists between the vacuum passages of the insert tool and the vacuum passages of the base plate when the insert tool is installed in the recess, the insert tool including a first set of the vacuum passages therethrough and a first seal extending along the upper surface of the insert tool, and a second set of the vacuum passages and a second seal extending along the upper surface of the insert tool, the first set of vacuum passages and first seal collectively defining a first vacuum system for exerting vacuum on the workpiece, and the second set of vacuum passages and second seal collectively defining a second vacuum system for exerting vacuum on the workpiece such that vacuum applied through the vacuum passages causes a first surface of said workpiece to be suctioned against the insert tool to permit an opposite second surface of said workpiece to be machined to a predetermined contour including at least one protruding feature, the upper surface of the insert tool defining at least one depressed region configured such that said at least one protruding feature is received into said at least one depressed region when said workpiece is turned over after the second surface has been machined so as to allow the seals of the insert tool to sealingly engage the second surface such that the first surface can be machined.

2. The workpiece holder assembly of claim 1, further comprising a plurality of said insert tools interchangeably installable in the recess in the base plate, each insert tool defining a configuration of depressed regions different from that of the other insert tools such that workpieces can be machined to have any of a plurality of different predetermined contours and protruding features by interchanging the insert tools.

3. The workpiece holder assembly of claim 1, wherein the vacuum passages in the insert tool comprise vacuum holes extending through a thickness of the insert tool.

4. The workpiece holder assembly of claim 3, wherein the vacuum passages in the insert tool further comprise vacuum slots formed in the upper surface of the insert tool and communicating with the vacuum holes.

5. The workpiece holder assembly of claim 1, wherein each of the seals of the insert tool comprises an elongate seal strip of resiliently compressible material retained in a groove formed in the upper surface of the insert tool.

6. The workpiece holder assembly of claim 5, wherein the groove has a minimum width adjacent the upper surface of the insert tool and the seal strip has a width exceeding said minimum width such that the seal strip is interference fit within the groove.

7. The workpiece holder assembly of claim 1, wherein the base plate is metallic and the insert tool is formed of a polymer material.

8. The workpiece holder assembly of claim 1, further comprising retaining devices adapted to engage the base plate and the insert tool for retaining the insert tool in the base plate when vacuum is inoperative.

9. The workpiece holder assembly of claim 1, wherein the base plate defines a first set of vacuum passages and a first seal extending along the upper surface of the base plate positioned such that vacuum in the first set of vacuum passages in the base plate is communicated to the first set of vacuum passages in the insert tool, and wherein the base plate defines a second set of vacuum passages and a second seal extending along the upper surface of the base plate positioned such that vacuum in the second set of vacuum passages in the base plate is communicated to the second set of vacuum passages in the insert tool.

10. A workpiece holder assembly, comprising:

a mill bed having a support surface adapted to support a workpiece to be machined, a portion of the support surface of the mill bed being recessed so as to define a well area therein;

a base plate adapted to be removably installed in the well area, a portion of a surface of the base plate that faces out from the well area being depressed so as to define a recess therein; and an insert tool adapted to be removably installed in the recess of the base plate, a surface of the insert tool that faces out from the recess defining at least one depressed region configured to receive at least one feature protruding from a surface of the workpiece, the insert tool further including at least one seal adapted to engage said surface of the workpiece when the workpiece is supported on the mill bed and insert tool;

the mill bed, base plate, and insert tool each defining vacuum passages formed therethrough and adapted to cooperate with the seal to communicate vacuum to the workpiece and suction the workpiece onto the insert tool.

11. The workpiece holder assembly of claim 10, further comprising a plurality of said insert tools interchangeably installable in the recess in the base plate, each insert tool defining a configuration of depressed regions different from that of the other insert tools such that workpieces having different configurations of protruding features can be machined by interchanging the insert tools.

12. The workpiece holder assembly of claim 11, wherein each insert tool comprises a generally plate-shaped member defining vacuum holes extending through a thickness thereof.

13. The workpiece holder assembly of claim 12, wherein the base plate includes at least one seal adapted to engage one of the insert tools installed in the recess of the base plate such that a sealed connection exists between the vacuum passages in the base plate and the vacuum holes in the insert tool.

14. The workpiece holder assembly of claim 13, wherein the seal in the base plate comprises an elongate strip of resiliently compressible material retained in a groove formed in the surface of the base plate that faces out from the well area of the mill bed.

15. The workpiece holder assembly of claim 12, wherein the seal in the insert tool comprises an elongate strip of resiliently compressible material retained in a groove formed in the surface of the insert tool that faces out from the recess in the base plate.

* * * * *